US010016796B2

(12) United States Patent
Ingvarsson

(10) Patent No.: US 10,016,796 B2
(45) Date of Patent: Jul. 10, 2018

(54) METHOD FOR ROLL-FORMING

(71) Applicant: Ortic 3D AB, Borlänge (SE)

(72) Inventor: Lars Ingvarsson, Borlänge (SE)

(73) Assignee: Ortic 3D AB, Borlänge (SE)

( * ) Notice: Subject to any disclaimer, the term of this patent is extended or adjusted under 35 U.S.C. 154(b) by 0 days.

(21) Appl. No.: 15/275,666

(22) Filed: Sep. 26, 2016

(65) Prior Publication Data

US 2017/0008053 A1 Jan. 12, 2017

Related U.S. Application Data

(62) Division of application No. 14/364,427, filed as application No. PCT/SE2012/051268 on Nov. 16, 2012, now Pat. No. 9,475,108.

(30) Foreign Application Priority Data

Dec. 11, 2011 (SE) ..... 1100912

(51) Int. Cl.
*B21B 13/00* (2006.01)
*B21B 31/02* (2006.01)
(Continued)

(52) U.S. Cl.
CPC ..... *B21B 13/00* (2013.01); *B21B 31/02* (2013.01); *B21B 31/20* (2013.01); *B21D 5/08* (2013.01);
(Continued)

(58) Field of Classification Search
CPC ..... B21D 5/08; B21D 5/083; B21D 5/086; B21D 5/12; B21D 5/14; B21B 1/08; B21B 1/088; B21B 1/09; B21B 1/092; B21B 1/095; B21B 1/098; B21B 1/12; B21B 1/22; B21B 1/24; B21B 1/26; B21B 1/28; B21B 2001/221; B21B 2001/225; B21B 2001/386; B21B 13/00; B21B 13/001; B21B 13/08; B21B 13/10; B21B 13/12; B21B 13/18; B21B 2013/006; B21B 2013/023; B21B 2013/026; B21B 2013/106; B21B 31/02; B21B 31/10;
(Continued)

(56) References Cited

U.S. PATENT DOCUMENTS 4,656,858 A 4/1987 Addison
5,176,019 A 1/1993 Brooks
(Continued)

FOREIGN PATENT DOCUMENTS

DE 10011755 A1 9/2001
DE 102004040257 A1 12/2005
(Continued)

*Primary Examiner* — Peter DungBa Vo
*Assistant Examiner* — Joshua D Anderson
(74) *Attorney, Agent, or Firm* — Dilworth & Barrese, LLP

(57) ABSTRACT

A method is provided for roll-forming a sheet metal strip (35) by driving the sheet metal strip through a row of forming stations (17, 18) having pairs of rollers (19, 20; 29, 30) directed towards each other and both holding the sheet metal strip therebetween and forming the sheet metal strip over roller edges. In every second forming station (12), two angles (41, 42) are gradually formed and in every second forming station two other angles (43, 44) are gradually formed.

9 Claims, 6 Drawing Sheets

(51) Int. Cl.
*B21B 31/20* (2006.01)
*B21D 5/08* (2006.01)

(52) U.S. Cl.
CPC ..... *B21D 5/083* (2013.01); *B21B 2013/006* (2013.01); *B21B 2031/023* (2013.01); *B21B 2031/026* (2013.01)

(58) Field of Classification Search
CPC ..... B21B 31/20; B21B 2031/023; B21B 2031/026; B21B 2031/206; B21B 2263/02
USPC ..... 72/226, 237–239
See application file for complete search history.

(56) References Cited

U.S. PATENT DOCUMENTS

| | | | | |
|---|---|---|---|---|
| 5,722,278 | A | 3/1998 | Horino et al. | |
| 6,820,451 | B2 * | 11/2004 | Renzzulla ..... | B21D 5/08 72/173 |
| 2004/0244454 | A1 | 12/2004 | McDonald | |
| 2011/0067472 | A1 | 3/2011 | Heinz et al. | |

FOREIGN PATENT DOCUMENTS

| | | | |
|---|---|---|---|
| EP | 2191906 | A1 | 6/2010 |
| JP | 7088559 | A1 | 4/1995 |
| JP | 7088560 | A1 | 4/1995 |

* cited by examiner

METHOD FOR ROLL-FORMING

FIELD OF THE INVENTION

The invention relates to a roll-forming machine comprising a stand and a row of forming stations comprising frames for carriers of pair of rollers being laterally displaceably mounted on the stand. The invention also relates to a method for roll-forming a sheet metal strip by driving the sheet metal strip through a row of forming stations having pairs of rollers directed towards each other and both holding the sheet metal strip therebetween and form the sheet metal strip over roller edges.

"Laterally" means that the frames are displaceable in lateral direction with respect to the extension of said row of forming stations along which a sheet metal strip to be roll-formed is intended to be fed through the roll-forming machine.

BACKGROUND OF THE INVENTION AND PRIOR ART

A roll-forming machine of the type mentioned above forming angles over the edges of the forming rollers is already known through SE 527722 C2.

However, such a roll-forming machine may not be used within the vehicle industry for producing beams having a complicated profile, such as a beam to be arranged above the wind shield of a vehicle, which is often bent in two planes in a double-bent shape. This is the reason why moulding technique has been used so far for producing such beams of high-strength sheet metal.

SUMMARY OF THE INVENTION

The object of the present invention is to provide a roll-forming machine enabling roll-forming of profiles having more complicated shapes, such as beams of the type mentioned above, and at the same time is flexible in the sense that manufacturing of very different shapes shall be possible.

This object is according to the invention obtained by providing a machine of the type defined in the introduction, which has an intermediate piece pivotally mounted on each frame for being pivoted around a vertical axis and two carriers of pair of rollers separately laterally displaceably mounted on each intermediate piece, each carriers of a pair of rollers comprises two axel pins for carrying a forming roller each and the two carriers of a pair of rollers having their axle pins directed towards each other.

By the combination of the different movabilities within the respective forming station: frame displaceable laterally with respect to the stand, intermediate piece pivotably mounted on the frame and the two carries of a pair of rollers separately displaceable laterally on the intermediate piece, as well as the fact the two carriers of a pair of rollers have their axle pins directed towards each other, the position and the direction of the pairs of rollers of the respective forming station may be varied within a very broad range and by that complicated profiles having very varying shapes may be roll-formed through the roll-forming machine according to the invention.

According to an embodiment of the invention the intermediate piece is tiltable laterally. By tilting the intermediate piece the carriers of a pair of rollers arranged thereon may be tilted, which enables manufacturing of profiles having twisted shapes and bending of a metal sheet by angles being larger than 90°. Tiltable laterally means here that the intermediate piece is pivotable about an axis along the extension of said row of forming stations, this axis will then normally be substantially horizontal or horizontal. Accordingly, this means that the axis stated further above to be vertical will when such tilting takes place change direction and deviate somewhat from the vertical position in a basic position but still be substantially vertical.

According to a further development of the embodiment of the invention mentioned above at least one frame has an upper part being mounted tiltable laterally with respect to a lower frame part mounted displaceable laterally on the stand, and the intermediate piece is arranged on the upper frame part and tiltable laterally with this. The arrangement of the intermediate piece to be pivotable about a vertical axis and tiltable laterally may in this way be realised in a simple and reliable way.

According to another embodiment of the invention the intermediate piece of at least one frame is displaceable laterally with respect to the frame. This movability increases the flexibility of the influence of the forming station in question upon a piece to be further roll-formed.

According to another embodiment of the invention the axle pins of the carriers of a pair of rollers are vertically movable. This means that said axle pins are displaceable in the vertical direction with respect to the stand, which preferably is achieved by arranging the axle pins displaceable vertically in the carriers of the pairs of rollers. This displaceability results in a possibility to vary the material shaping influence of the respective pair of rollers upon a material piece moved between the rollers. According to a further development of this embodiment the axle pins of each carriers of a pair of rollers of at least one forming station are vertically movable with respect to the stand independently of the axle pins of the other carrier of a pair of rollers mounted on the same intermediate piece. The possible variation of the influence of the rollers of a forming station upon a material piece or blank is thereby broadened further.

According to another embodiment of the invention the axle pins of the two carriers of a pair of rollers arranged on the same intermediate piece extend in parallel with each other.

According to a further embodiment of the invention all said forming stations of the machine have the same movability mutually and with respect to the stand for the parts belonging to the station. This means a maximum degree of variation of the shapes obtainable for profiles produced by feeding a material piece through the roll-forming machine. However, it is within the scope of the invention to design some of the forming stations with a movability of some part belonging thereto being restricted to some extent so as to reduce the cost of the machine, although this would in most cases not be considered.

A method according to the invention is characterized in that in every second forming station two angles are gradually formed and in every second forming station two other angles are gradually formed. The sheet metal strip is then driven through the forming stations of a roll-forming machine according to the invention. A large amount of different shapes of sheet metal strip driven through the roll-forming machine may in this way be obtained.

Further advantages as well as advantageous features of the invention appear from the following description of embodiments of the invention.

BRIEF DESCRIPTION OF THE DRAWINGS

Embodiments of the invention cited as examples will hereinafter be described with reference made to the appended drawings. In the drawings.

DETAILED DESCRIPTION OF EMBODIMENTS OF THE INVENTIONS

Figure 1:
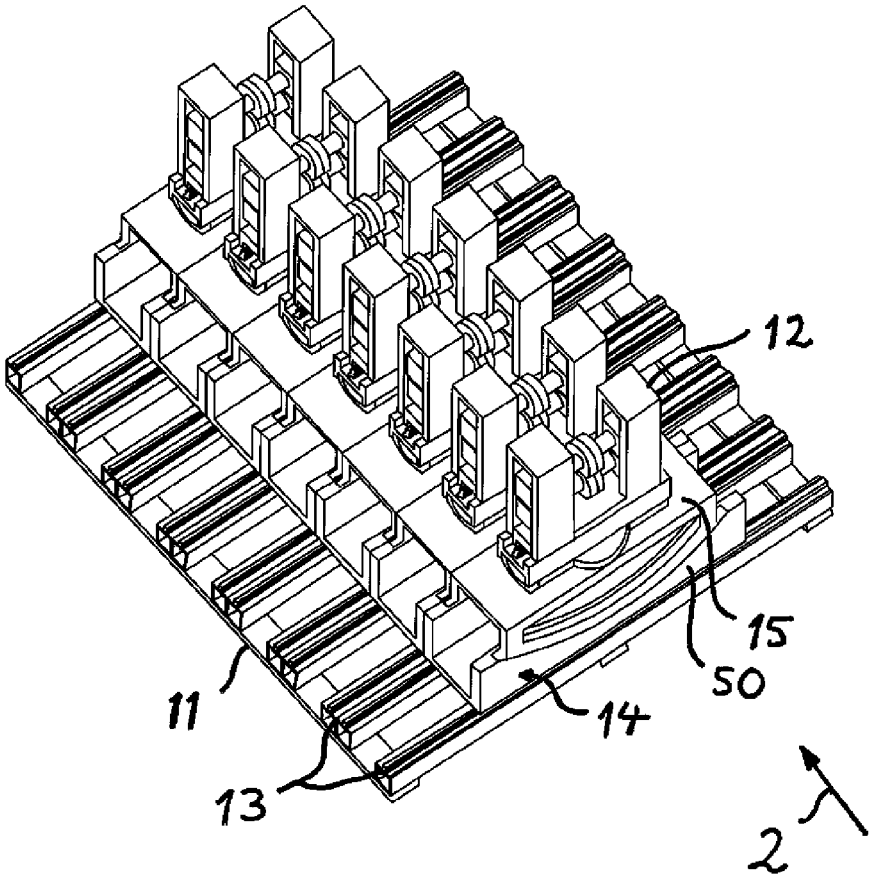
FIG. 1 is a simplified perspective view of a part of a roll-forming machine according to the invention.

FIG. 1 shows very schematically the first roll-forming stations of a roll-forming machine according to the invention. The roll-forming stations are arranged in a row so as to successively form a material piece, such as a sheet metal strip, moving through the machine along said row. Such a machine has then normally a considerably higher number of roll-forming stations than shown, such as for example 15-30 such stations, but the invention is not restricted to any particular number of forming stations of the machine. Power means for achieving the movements to be described below of different parts of the machine have been omitted in the figures for simplifying the views and better illustrating other parts of the machine. These power means are advantageously electric motors for enabling a control of the movements of the parts with a high accuracy, but it is also within the scope of the invention to use other types of power means, such as controlled through pneumatic or hydraulic.

The machine has a stand 11 configured to be arranged in a fixed position and which carries a pair of guides for each forming station. A frame 14 is displaceably mounted in each such pair of guides.

Figure 2:
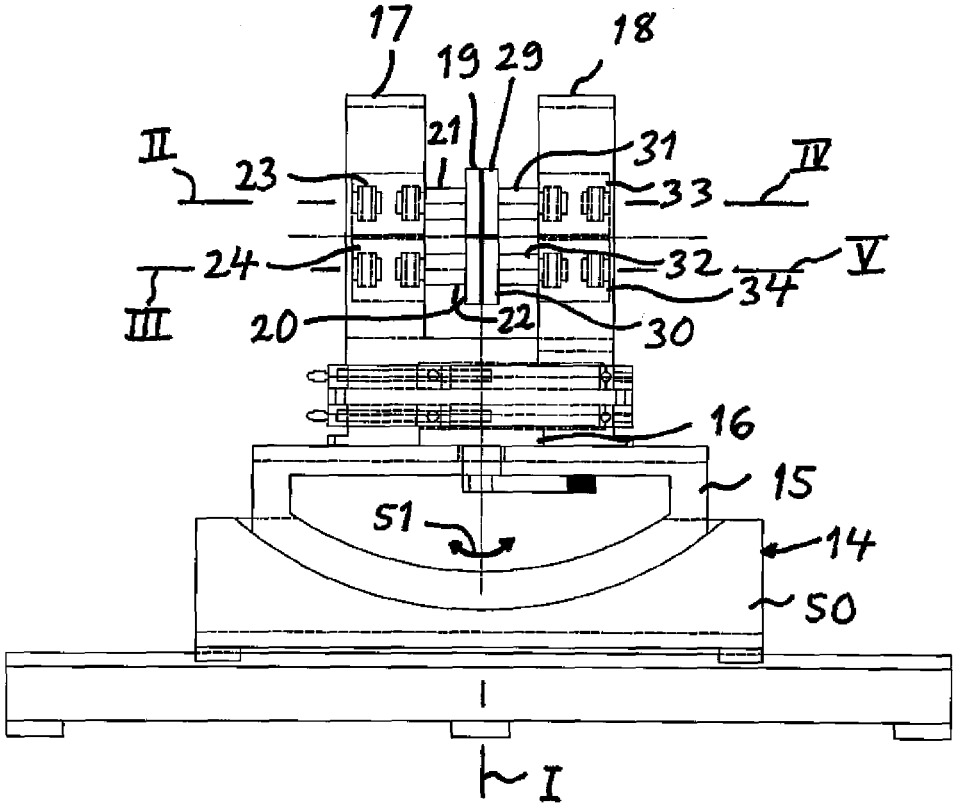
FIG. 2 is a view of the roll-forming machine in FIG. 1 in the direction of the arrow 2.

The forming station 12 being the first one according to the feeding direction (arrow 2) shown in FIG. 1 with a frame 14 arranged in a first pair 13 of guides is shown in FIG. 2. The frame 14 has a lower part 50 in the form of a cradle and an upper part 15 arranged laterally tiltable with respect to the lower part and by that with respect to the stand, as indicated by the arrow 51. An intermediate piece 16 is pivotably mounted on the upper part 15 of the frame about an axis I which in a normal position shown in FIG. 2 has a vertical direction, in which it is assumed that the stand 11 and said pair of guides extend in a horizontal plane.

Figure 3:
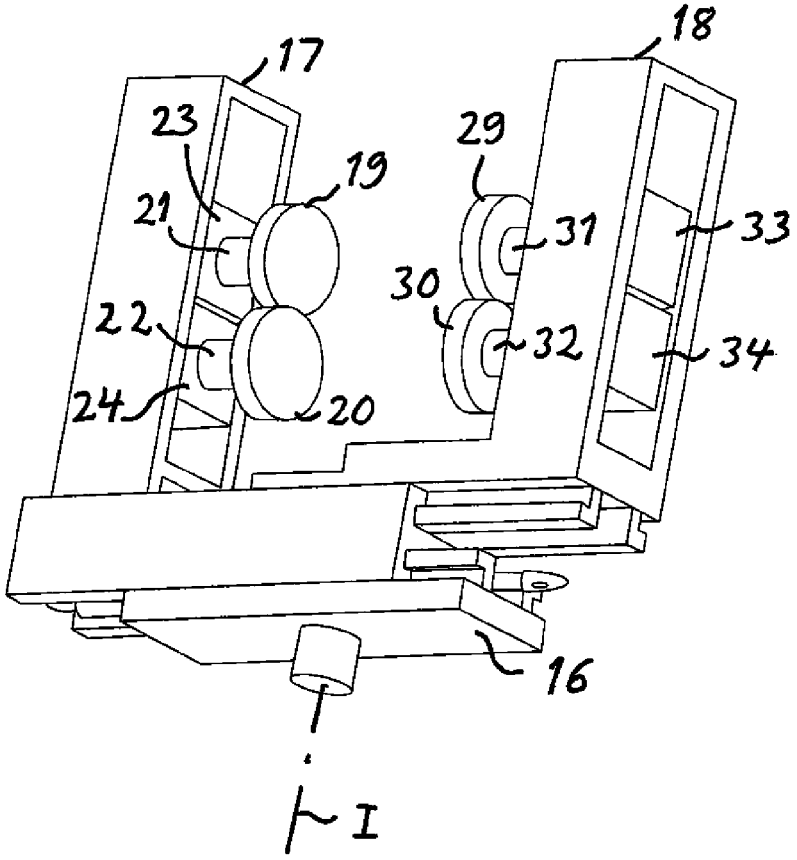
FIG. 3 is a perspective view of a part of a forming station of a roll-forming machine according to FIG. 1, FIGS. 4 and 5 show examples of consecutive roll-forming steps for roll-forming a flat strip.

The intermediate piece 16 carries two carriers 17, 18 of a pair of rollers being separately, i.e. independently of each other, displaceable laterally with respect to the intermediate piece. The carrier 17 of a pair of rollers carries two forming rollers 19, 20 on parallel axle pins 21, 22 and these axle pins are carried by two pulleys 23, 24, which are individually displaceable in the vertical direction, so that the position of the axle pins in the vertical direction may be adjusted separately. Accordingly, the forming rollers of each pair of rollers are vertically movable with respect to each other so as to adjust the distance between the rollers depending upon the thickness of the material piece to be formed in the machine. The carrier 18 of a pair of rollers is designed in the same way as the carrier 17 of a pair of rollers with two forming rollers 29, 30, axle pins 31, 32 and pulleys 33, 34. The axle pins of the two carriers of a pair of rollers are directed towards each other and extend in parallel with each other. Reference is made to FIG. 3 with respect to the construction of the intermediate piece with carriers with a pair of rollers and forming rollers.

Figure 4:
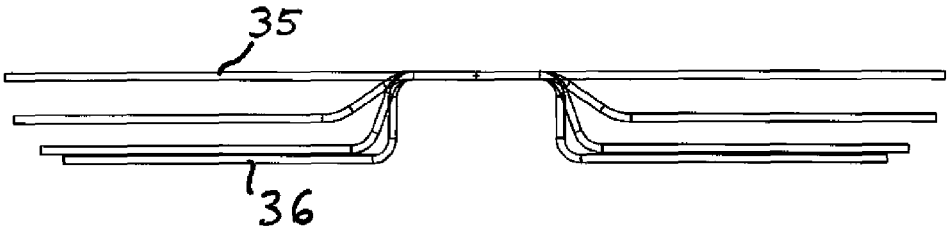
Figure 6:
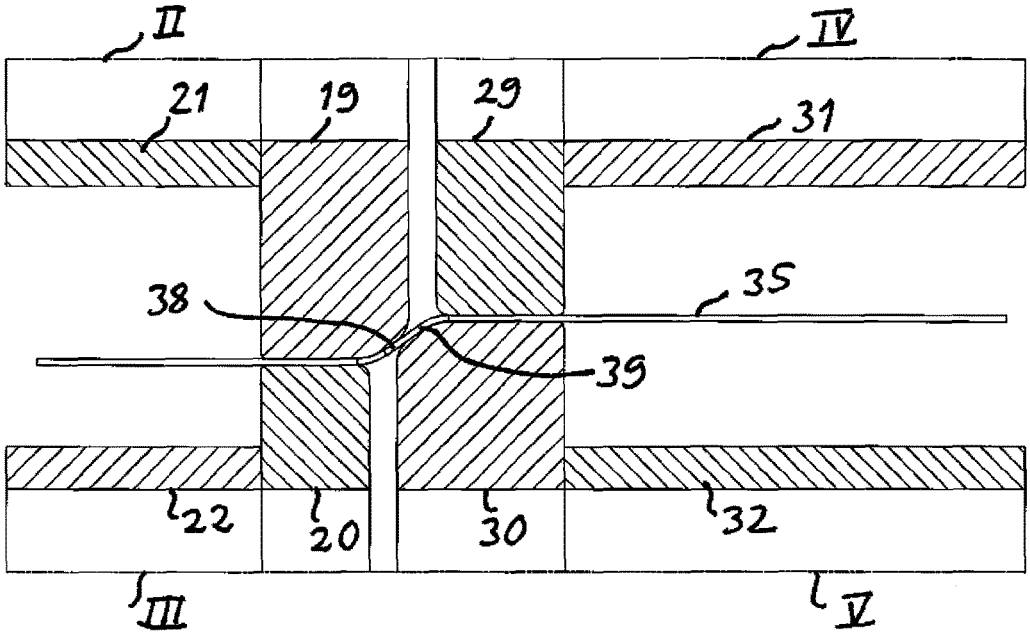
FIG. 6 illustrates schematically the roll-forming in one of the steps shown in FIG. 4.

FIG. 4 shows three steps of the forming of a blank in the form of a sheet metal strip 35 being flat when it reaches the first forming station in the row of forming stations and then during the travel through the machine is successively formed to a hat profile 36 by consecutive forming stations. FIG. 6 shows how in the first forming step in a first roll-forming station 12 the blank 35 may be given an intermediate profile having two angles. The axle pin 21 of the forming roller 19 has then the rotation axis II, the axle pin 22 of the forming roller 20 has the rotation axis III, the axle pin 31 of the forming roller 29 has the rotation axis IV and the axle pin 32 of the forming roller 30 has the rotation axis V. The strip 35 is during the forming held between the pair of rollers 19, 20 and the pair of rollers 29, 30 and is formed over the rounded edges 38, 39 of the rollers 19, 30 and runs free between these edges. It appears that the rollers of a pair of rollers may have different shapes and dimensions, and this may also be the case for rollers from one forming station to another.

Figure 7:
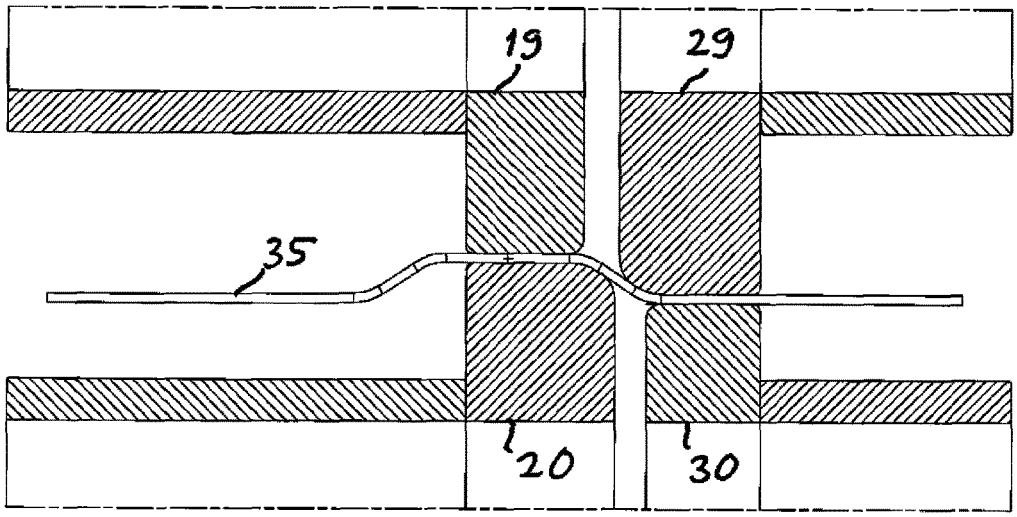
FIG. 7 illustrates schematically a roll-forming following the roll-forming shown in FIG. 6.

The other side of the hat profile, the one to the right as seen in FIG. 6, is formed in the corresponding way in the next forming step in the next roll-forming station, such as shown in FIG. 7. The next forming step is then carried out in a third forming station of the left side again and so on. Thus, in every second forming station two angles 41, 42 are successively formed on one side and two angles 43, 44 on the other side until the angles of both sides are formed to the profile shown in FIG. 5. By in this way alternating between the forming of the two sides adjacent forming stations may be arranged close to each other even if forming according to comparatively large angles is to be carried out. Thus, there will be a type of zig zag arrangement of the stations with the roller carriers along said row.

Figure 5:
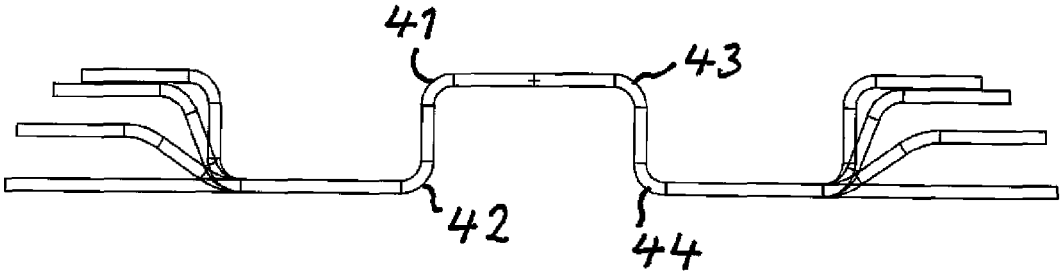

FIG. 5 shows how the hat profile according to FIG. 4 may be subjected to continued roll-forming further downstream in the roll-forming machine according to the invention. The forming is also here carried out alternatively on one and one the other side.

By the fact that the machine is short and compact (the forming stations follow directly upon each other) and have so many possibilities for movements the machine may be used to manufacture profiles having a varied shape along the length thereof and which may be both double-bent and twisted. The tiltable arrangement of the rollers in the lateral direction through the tiltability of the intermediate piece with respect to the stand improves the possibility to make twisted profiles and makes it possible to over-bent angles with angles larger than 90° and also form Z-like profile shapes. The pivotable arrangement of the rollers through the pivotability of intermediate piece with respect to the frame and by that to the stand contributes to an increased possibility of variations of the forming.

Figure 8:
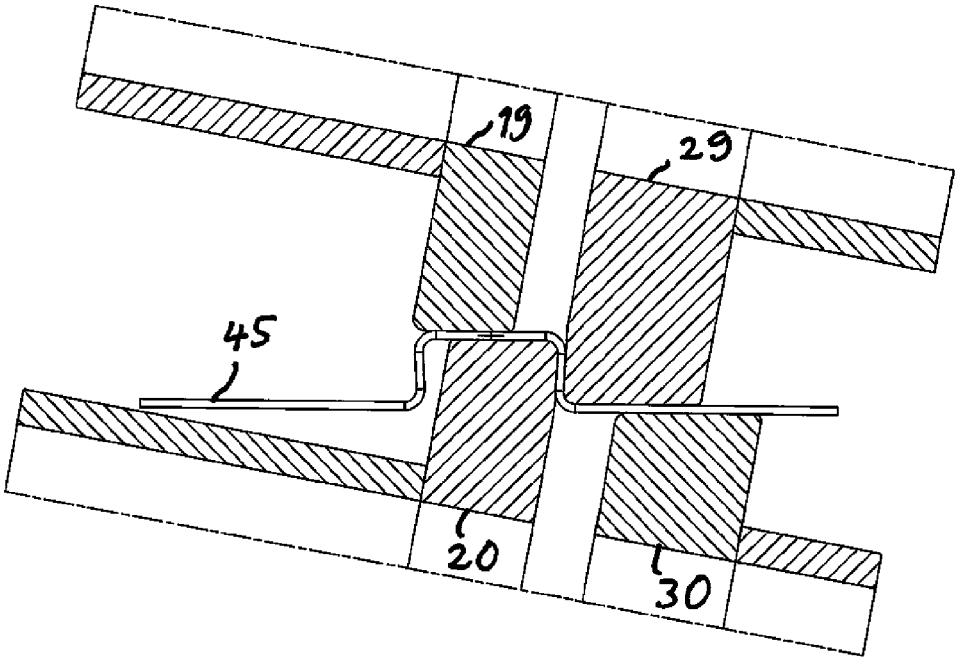
FIG. 8 illustrates roll-forming of a profile having over-bent angles.
Figure 9:
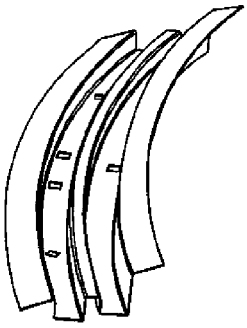
FIG. 9 shows in perspective view a beam for arranging above the wind shield of a vehicle obtained through roll-forming in a roll-forming machine according to the invention.

FIG. 8 shows how the bending of a blank to a profile 45 having over-bent angles may be achieved through the roll-forming machine according to the invention, whereas FIG. 9 shows a double-bent wind shield beam to be applied above the wind shield of a vehicle, such as a private car, which has been manufactured by bringing a flat sheet metal strip to pass through the roll-forming machine according to the invention and then control the different forming stations in a suitable way for obtaining the cross section varying along the length of this beam.

The invention is of course not in any way restricted to the embodiments described, but many possibilities to modifications thereof would be apparent to a person skilled in the art without departing from the scope of the invention as defined in the appended claims.

The invention claimed is:

1. A method for roll-forming a sheet metal strip (35) comprising providing a row of forming stations comprising a set of first alternating forming stations and a set of second alternating forming stations arranged in a zig-zag arrangement along a feeding direction such that the first alternating forming stations and the second alternating forming stations are alternately arranged in the feeding direction with the first alternating forming stations arranged on one lateral side of the sheet metal strip and the second alternating forming stations arranged on an opposite lateral side of the sheet metal strip, driving the sheet metal strip through the row of forming stations (17, 18) along the feeding direction, each of the forming stations having pairs of rollers (19, 20; 29, 30) directed towards each other and holding the sheet metal strip therebetween and forming the sheet metal strip over roller edges of the pairs of rollers, gradually forming two angles (41, 42) only on the one lateral side of the sheet metal strip in every first alternating forming station (12) and gradually forming two other angles (43, 44) only on the opposite lateral side of the sheet metal strip in every second alternating forming station.

2. A method for roll-forming a sheet metal strip (35) comprising providing a roll-forming machine comprising a row of roll forming stations (17, 18), the roll forming stations comprising a set of first alternating forming stations and a set of second alternating forming stations alternately arranged along a feeding direction, each forming station having pairs of rollers (19, 20; 29, 30) directed towards each other, wherein the roll-forming machine further comprises a stand (11), frames (14) mounted on the stand (11), an intermediate piece (16) pivotally mounted on each frame, two carriers of respective pairs of the pairs of rollers of each forming station mounted on each intermediate piece, each carrier of the pairs of rollers comprising two axle pins (21, 22; 31, 32) directed towards each other for carrying each forming roller (19, 20; 29, 30) of the pairs of forming rollers, laterally-displacing the frames (14) mounted on the stand (11), pivoting the intermediate piece (16) pivotally mounted on each frame (14) around a vertical axis (I), separately laterally displacing the carriers (17, 18) mounted on each intermediate piece (16), driving the sheet metal strip through the row of forming stations (17, 18) along the feeding direction as the pairs of rollers (19, 20; 29, 30) hold the sheet metal strip therebetween and form the sheet metal strip over roller edges of the pairs of rollers, gradually forming a first set of two angles (41, 42) on one lateral side of the sheet metal strip in every first alternating forming station (12) and gradually forming a second set of two angles (43, 44) on an opposite lateral side of the sheet metal strip in every second alternating forming station.

3. A method according to claim 2, comprising laterally tilting the intermediate piece (16).

4. A method according to claim 3, comprising laterally tilting an upper frame part (15) of at least one frame (14) with respect to a lower frame part (50), laterally displacing the lower frame part (50) on the stand (11), and arranging and laterally tilting the intermediate piece (16) on the upper frame part (15).

5. A method according to claim 2, wherein the intermediate piece (16) of at least one frame is laterally displaceable with respect to the frame (14).

6. A method according to claim 2, wherein the axle pins (21, 22; 31, 32) of the carriers of pair of rollers are vertically movable.

7. A method according to claim 6, wherein the axle pins (21, 22; 31, 32) of each carrier (17, 18) of a pair of rollers of at least one forming station (12) are vertically movable with respect to the stand (11) independently of the axle pins of the other carrier of a pair of rollers mounted on the same intermediate piece (16).

8. A method according to claim 2, wherein the axle pins (21, 22; 31, 32) of the two carriers (17, 18) of a pair or rollers arranged on the same intermediate piece (16) extend in parallel with each other.

9. A method according to claim 2, wherein the parts belonging to a station have in all said forming stations (12) of the machine the same movability mutually with respect to the stand (11).

* * * * *